US006199407B1

(12) United States Patent
Nikolov

(10) Patent No.: US 6,199,407 B1
(45) Date of Patent: Mar. 13, 2001

(54) METHOD AND DEVICE FOR PRODUCTION OF KNITWEAR

(76) Inventor: Peter R. Nikolov, "Stephan Dimitrov" str., 9, 1225, Sofia (BG)

( * ) Notice: Subject to any disclaimer, the term of this patent is extended or adjusted under 35 U.S.C. 154(b) by 0 days.

(21) Appl. No.: 09/509,235

(22) PCT Filed: Sep. 24, 1998

(86) PCT No.: PCT/BG98/00015

§ 371 Date: Mar. 22, 2000

§ 102(e) Date: Mar. 22, 2000

(87) PCT Pub. No.: WO99/15724

PCT Pub. Date: Apr. 1, 1999

(30) Foreign Application Priority Data

Sep. 24, 1997 (BG) ..... 101910

(51) Int. Cl.[7] ..... D04B 35/00
(52) U.S. Cl. ..... 66/1 R; 66/62
(58) Field of Search ..... 66/1 R, 62, 64, 66/60 R, 68, 75.1, 103, 105, 97, 125 R

(56) References Cited

U.S. PATENT DOCUMENTS 5,987,929 * 11/1999 Bostani ..... 66/1 R

FOREIGN PATENT DOCUMENTS 651913 12/1964 (BE) .

195 38 938 A1 4/1997 (DE) .

* cited by examiner

*Primary Examiner*—Danny Worrell
(74) *Attorney, Agent, or Firm*—Knobbe, Martens, Olson & Bear, LLP

(57) ABSTRACT

A method and device for knitting of hosiery eliminates disadvantages of the conventional techniques. With this method of knitting, the number of loop-formation steps are reduced and loop transfer does not depend on loop formation, both stops being performed simultaneously. Yarn pulling-out is replaced with pushing-out from the bobbin to the needle. Thus, the yarn is not over-stretched and the duration of the process of loop knitting is shortened. This method employs a device for knitting where the milled needle slots, loop-forming edges, the yarn pressing mechanism and the fabric straining mechanism have are not employed. This device instead comprises a needle fixing mechanism and a specific mechanism for taking back and pressing the yarn called a Chet Jack. The needle is set-in-motion, not by a knitting system or individual motors but by a mechanism of type herein called "gun" that employs electromagnetic, mechanical or pneumatic operation. The hosiery knitting device includes the following mechanisms: a needle fixing mechanism, a needle operation mechanism (i.e., "gun"), yarn pushing out mechanism (yarn distributor) and yarn taking back mechanism (Chet Jack).

13 Claims, 3 Drawing Sheets

METHOD AND DEVICE FOR PRODUCTION OF KNITWEAR

PRIORITY APPLICATIONS

This application is the U.S. national phase application under 35 U.S.C. § 371 for the International Application No. PCT/BG98/00015.

BACKGROUND OF THE INVENTION

The invention is in the field of cross-knitting units, where the yarn is guided and fed across the needles axle (in contrast with longitudinal knitting where the yarn is fed along the needle's axle).

Well-known level of techniques includes methods and devices for knitting of hosiery. In case of usual cross-knitting, the needle is operated by a knitting system or the needles are operated by individual motors for each needle. Thus, the reciprocation of the needle is ensured. Both methods are of relatively poor productivity and, on the other hand, in the course of loop formation it over-stretches the yarn and breaks its structure.

Method of Knitting of Hosiery

Well-known knitting techniques include a method of knitting based on the group action upon the needle. This method includes the following sequence of steps:

Step 1: The knitting system moves across the reed. Thus, the needle feel in the slot of the knitting system, starts to be pushed out forward. At the time of reaching of the next needle it also falls into the slot of the knitting system and starts to be pushed out forward. At the same time the previous needles goes on to be pushed out forward. This cycle is repeated continuously until the knitting system comes out of needle's field.

Step 2: When the needle has reached certain position the yarn guide piles a thread on it. After this operation, this needle starts to retire backward pulling out the yarn through the next needles all the way from the yarn guide, thus each next needle is given a yarn by the yarn guide but the previous needles draw some thread from the next needles and the yarn guide.

Step 3: When the needle reaches the initial knitting position (approximately around fore-side of the reed), the previous yarn held by the needle is dropped. Thus a loop is formed.

Step 4: The needle goes on movement backward drawing a yarn through the next needles and thread guide until some yarn with the length required is drawn for the next loop. The following needles also move themselves backward until some yarn of length required is drawn for the next loop.

Step 5: The needle starts moving forward to the initial knitting position. During movement forward the needle loosens the yarn that has been taken. During movement forward the next needle also loosens the yarn that has been taken.

Step 6: After a while, when the above-mentioned act have spread itself along the reed, it effects the general strain of the knitted fabric drawing the new formed loops and together with them the new yarn downward; the general straining over-stretches new-formed loops partially to be able to strain the new-piled yarn.

Step 7: A yarn forming the next loop is prepared at the time that the fore-side of the reed is reached by the needle. It is possible for this yarn to be pulled by the general straining.

Step 8: Throwing a loop across a next or an opposite needle is performed by knitting the loop on the giving needle (Steps 1–7) and loop forming (Steps 1–7) is paused.

Step 9: A special throwing-across system transfers the loop over on a needle that belongs to the opposite reed.

Step 10: The opposite reed moves aside that makes the loop to take place to be thrown across against the taking needle.

Step 11: A specific transferring system reverses the loop to the taking needle.

The so-described steps are realized as a cycle and without interruption.

One basic disadvantage of well-known level of the knitting method is relatively low productivity as a result of a long duration of loop formation action. Another disadvantage is forced pulling of the yarn that causes its over-stretching.

Knitting Device

Reed—Needle's Slot

The reed is a basic element of the known flat and circular knitting-looms. It is usually a plate or a ring where are across-threaded special slots that the needles are put in.

One disadvantage of the well-known reed is that it has too large an area that the needle contacts with that is a precondition for high friction.

Reed—Loop Forming Edge

One of the elements of the known reed is so called loop-forming edge. This is a passive part separating the needles from each other and allows formation of two loops by two contiguous needles.

A disadvantage is its passivity, that does not allow formation of loops of various length.

Reed—Yarn Pressing

In the actual level of technics a special device is used for pressing of the yarn upon the needle. It is Press Jack to keep the last knitted loop to be pressed upon the needle.

A disadvantage of mentioned device is the limited number of functions that it can perform and a complex setting in motion that it requires.

Reed—Fabric Tension

In the flat and circular well-known knitting-looms general straining of the knitted fabric is applied. The reed—fabric tension makes a general but irregular straining of all the loops.

A disadvantage is the general but irregular strain of all the loops that causes yarn structure's break.

Yarn Guidance

In well-known knitting looms the yarn in guided by a thread guide which moves across the needles by means of the knitting system or by help of its own mechanism for setting in motion. The motion of the yarn guide pulls by force a yarn from the bobbin. A disadvantage of this way of yarn guidance is the excessive pulling out of the yarn breaking its structure in too large scope and it could not guarantee the specific weight of the product measured, e.g., in grams per square meter (g/sq.m).

Needle Operation—Pulling Out of a Yarn to Form a Loop

Well-known knitting needle is set in motion reciprocately by which realizes its function to form loops.

Being operated by knitting system or an individual motor the needle pulls out certain amount of yarn to form a loop with certain length.

A disadvantage is pulling out the yarn by force by reason of over-stretching of the thread that makes the quality of the hosiery product to be difficult of reaching a required specific weight.

SUMMARY OF THE INVENTION

The invention comprises a method and device for knitting of hosiery where disadvantages of the existing technics level are eliminated.

This is possible to be achieved by the method of knitting where loop-formation stages are shortened, loop transfer does not depend on loop formation and both are performed simultaneously; yarn pulling-out is replaced with pushing-out of it all over the way from the bobbin to the needle. Thus, the yarn is not over-stretched, the duration of the process of loop knitting is shortened.

This method is realized by a device for knitting where the milled needle slots, loop-forming edges, the yarn pressing mechanism and the fabric straining mechanism have dropped out. Instead, this device comprises a needle fixing mechanism and a specific mechanism for taking back and pressing the yarn, i.e., a Chet Jack.

Furthermore, needle setting-in-motion by the knitting system or individual motors is replaced by a mechanism of type called "gun" with electromagnetic, mechanical or pneumatic operation.

The hosiery knitting device includes the following mechanisms: needle fixing mechanism, needle operation mechanism (i.e., "gun"), yarn pushing out mechanism, and yarn taking back mechanism (Chet Jack).

BRIEF DESCRIPTION OF THE DRAWINGS

A preferred embodiment of a device and method is described in detail below in connection with the following figures.

DETAILED DESCRIPTION OF THE PREFERRED EMBODIMENT

Hosiery Across Knitting Method

Figure 1:
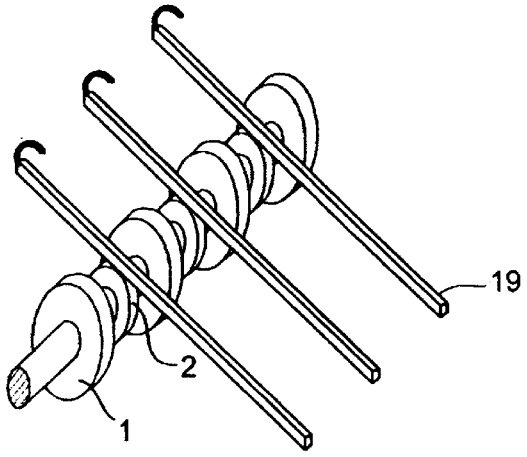
FIG. 1 shows a needle fixing mechanism.

The knitting method of the present invention includes the following sequence of actions:

Step 1: Needle operation mechanism 9 shoots the needle from initial knitting position 13 to the position of taking a yarn 10 where the yarn guide 11 piles a yarn upon the needle and the near-by Chat Jack 3, and the yarn pushing-out mechanism 7 pushes out the yarn of required length 16 to form a loop.

Step 2: The needle setting-in-motion mechanism 9 takes the needle back in the initial knitting position 13, and the needle takes back a part of pushed out yarn (or the entire pushed out yarn). At the same time, the needle drops the previous piled yarn and forms a loop 12. Simultaneously, Chet Jack 3 presses the yarn onto the needle and takes back a part of the new-piled yarn upon both the Chet Jack and the needle yarn if there is any.

Step 3: Loop transferring mechanism 17, positioned against the loop giving needle 19, takes off the loop 18 from the needle and hold it on itself, carries the loop 18 to the loop taking needle 20 and throws the loop across from itself to the needle 20. These actions occur simultaneously with those ones described in step 2.

Knitting Device

Needle Fixing Mechanism

Needle fixing mechanism (FIG. 1) comprises a bed, formed by two big disks 1 set at a distance by a little disk 2 where the needle lies. The mechanism when it is necessary includes more than one bed to be ensured linearity of the needle movement. The contact of the needle with the disks is within a not too large area which reduces the friction of the needle. It is possible for this construction to be united. The disks could be circular-shaped and the needle bed could be formed by disk 1 and disk 2 lined consecutively.

Needle Operation Mechanism of Type "Gun"

Figure 4:
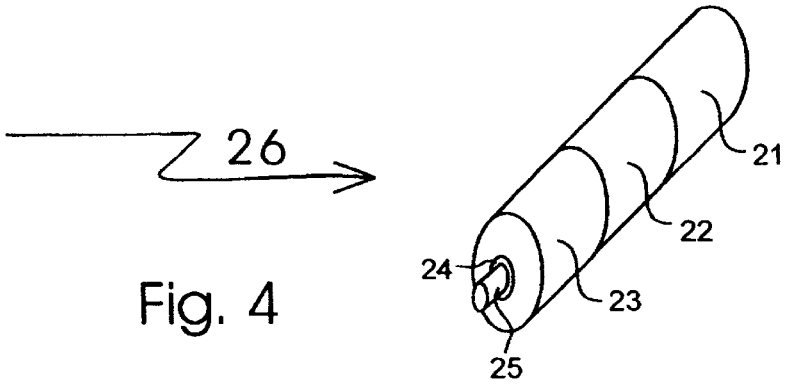
FIG. 4 depicts a needle operation mechanism of type "gun" with electromagnetic operation.

The gun of electromagnetic operation 26 (FIG. 4) comprises three bobbins 21, 22, 23 installed on a common sleeve 24 inside of which pervious to magnetic core 25 moves. The needle joins this core. The bobbins 21, 22, 23 are dimensioned in such a way that the center of the first bobbin 21 conforms to the initial position of the needle 13, i.e., the initial knitting position. The center of the third bobbin 23 conforms to the position of the yarn taking needle 10, and the center of the second bobbin conforms to any medial needle position.

At the time of feeding supply in the second bobbin 22, the core 25 moves and centers itself towards the formed magnetic field of the second bobbin, that causes shooting of the needle to the second position. At the time of feeding supply in the third bobbin 23, the core moves and centers itself towards formed magnetic field shooting the needle to the third position 10. At the time of feeding supply in a number of the bobbins, the core moves and centers itself towards the common magnetic field. By operating the bobbins in the reverse order, they take the needle back to the initial knitting position 13.

This mechanism can also work with four bobbins in which case the fourth bobbin conforms to position behind the initial knitting position of the needle.

Figure 5:
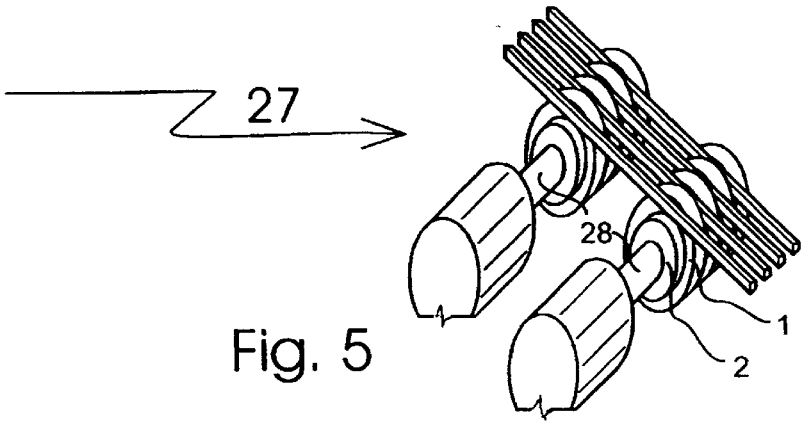
FIG. 5 shows a needle operation mechanism of type "gun" with mechanical operation.

The gun with mechanical operation 27 (FIG. 5) comprises disks 1 and 2 situated around a shaft 28. The needle is installed at a distance from it in such a way that hangs over disk 2 and is not in contact with disk 1. Disks 1 and 2 may be the same and may be united.

This construction is repeated in second point of the needle where both shafts 28 turn in different directions. Being pressed upon one of the shafts, the needle is drawn by the shaft through disks 1 and 2 and afterwards the shaft shoots the needle forward; when the needle is pressed upon the other shaft 28, the shaft shoots it backward. Both positions of the needle conform to the initial knitting position of the needle 13 and position of taking a yarn 10.

Figure 6:
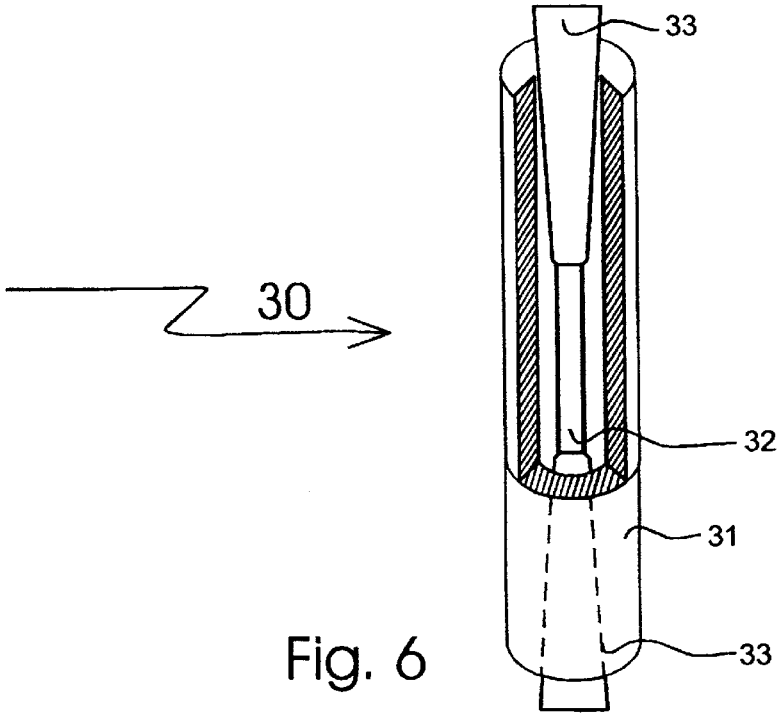
FIG. 6 depicts a needle operation mechanism of type "gun" with pneumatic operation.

The pneumatic operation gun 30 (FIG. 6) is a mechanism comprising a double-side air cylinder 31 in which have been put a special double-side piston 32. The piston 32 is a cylinder 32 on both sides of which circular brushes 33 as a continuation of the piston juts out. The brushes form natural cones and congests the piston to the walls of the cylinder 31. The needle is joined to the piston.

At the time of feeding some air from the one side of the air cylinder 31, the nearby brush 33 of the piston 32 swells and congests the cylinder and the distant brush 33 shrinks, letting the air pass around itself. Thus, the air shoots the piston forward. In case of the reverse feeding of air, the piston shoots itself backward. The piston can work by blowing air as well as by the suction of air, and joining the needle could be along the pistons axle.

Yarn Taking Back Mechanism (Chet Jack)

Figure 3:
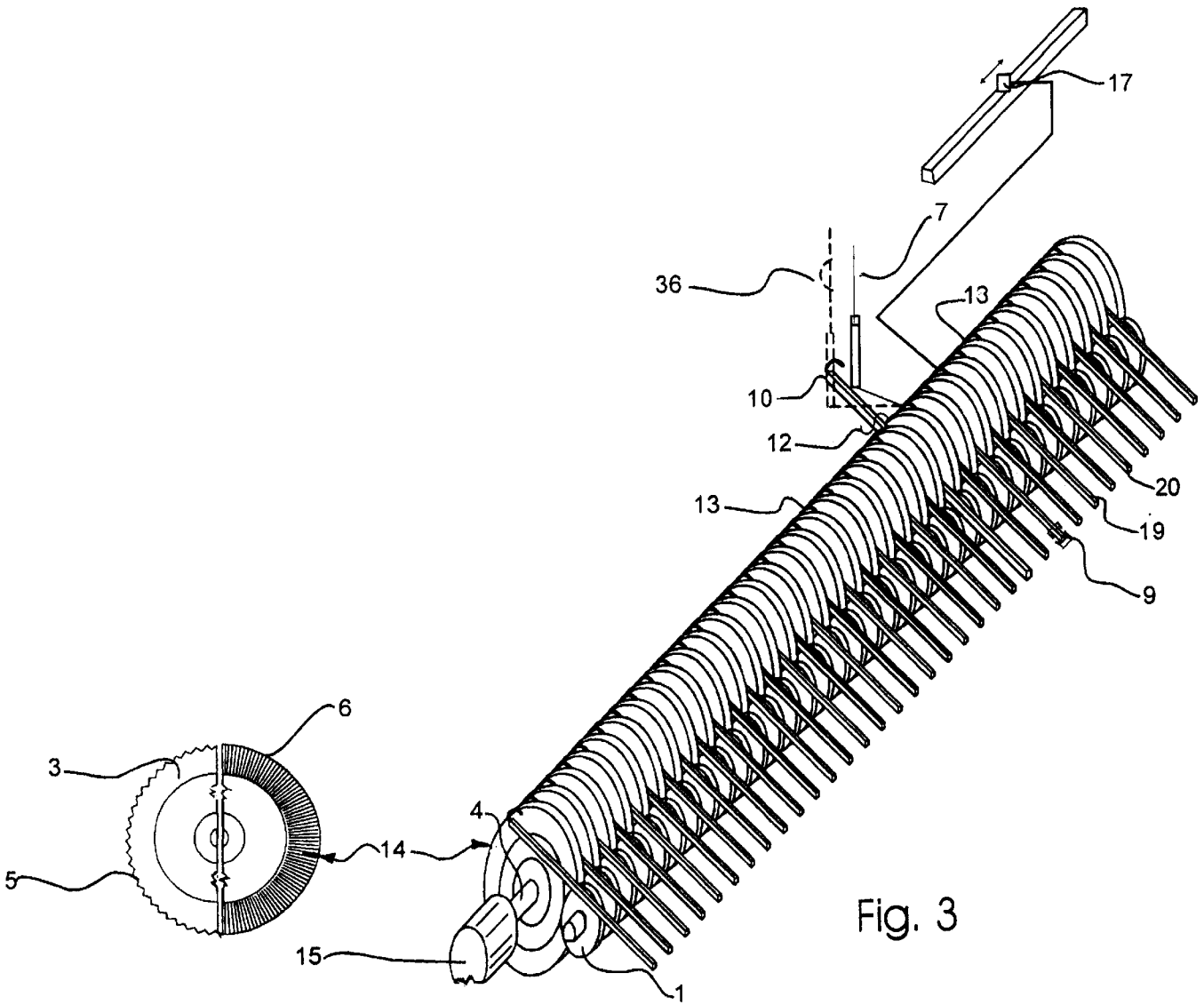
FIG. 3 depicts a yarn taking back mechanism (Chet Jack)

Chet Jack or yarn retriever (FIG. 3) comprises disks 3 with a soft pliable outer edge with changeable geometry, strung around shaft 4. There is at least one disk Chet Jack 3 between two of the needles and the needles are installed over or below the shaft axle 4. Chet Jack are strung around the shaft freely in such a way that the windage enough for their skidding towards the shaft is ensured and in such a way Chet Jack with their soft edges 14 takes part in loop formation.

The shaft 4 turns 15 and by a frictional, magnetic or another kind of gear, the rotating movement of the shaft 4 is imparted on the disks of the Chet Jack 3 with admissible skidding. The yarn guide 11 piles a thread upon the needle and the Chet Jack. The needle takes back a part of the pushed out yarn and forms a loop. The Chet Jack takes back a part of the pushed out yarn.

The exterior profile of Chet Jack is prepared with special shaped beds (teeth) where piled yarn sinks easy and goes out hard from the bed 5. The exterior profile of the Chet Jack could be prepared as a brush 6 so that the Chet Jack is swung round the shaft steadily 4. The shaft and brush could be united.

Yarn Push-Out Mechanism

Figure 2:
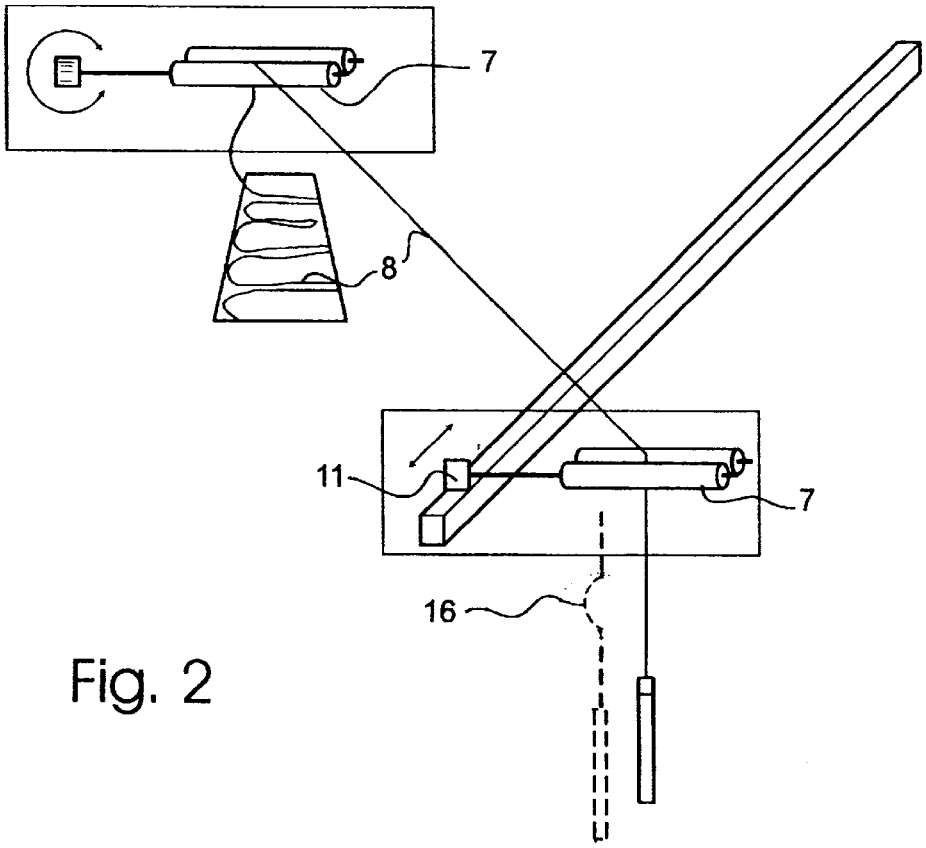
FIG. 2 shows a yarn pushing out mechanism.

The yarn distributor (FIG. 2) comprises two feeders each comprising two shafts 7 with specific profile that clutch each other. The pressure of the shafts on each other is set so that sufficient clutching is ensured which does not allow skidding. The yarn 8 is pressed between both shafts. The shaft's profile ensures the positioning of the yarn between them. One of the shafts turns round its axle, and the other one also turns round its axle synchronously. A required amount of yarn is pushed out by the shaft's which are rotated by a motor. This feeder is installed on a yarn guide 11.

Along the yarn, from the bobbin to the needle there are two of so described feeders: one near the bobbin which winds yarn off of the bobbin, and one near the yarn guide's nozzle which piles yarn upon the needle. The straining and slacking of the yarn between the both feeders is controlled by the synchronous operation of each one.

The first of the feeders unwinds a yarn of a required length from the bobbin and ensures certain reserve of yarn for the second feeder. The second one distributes and feeds the needle with some yarn for each of loops. Both feeders could also work in a reverse order returning needless excess yarn towards the bobbins direction.

What is claimed is:

1. A method of cross-knitting comprising:

shooting a needle from an initial knitting position with a gun to a position for taking of yarn;

pushing out yarn from a thread guide and piling it upon the needle;

retracting the needle back to said initial knitting position thereby taking back the pushed out yarn and forming a loop; and pressing the yarn to said needle simultaneously and taking back some needless part of the pushed out yarn if there is any and at the same time taking down a loop of the feeding needle with a loop transferring mechanism and conveying said loop to a taking needle by throwing it across and onto said taking needle.

2. The method of claim 1, wherein said loop is formed by one needle.

3. The method of claim 1, wherein said loop is formed simultaneously with more than one next needles.

4. A cross-knitting device comprising:

a needle bed formed by first and second discs set at a distance by a third disc;

at least one knitting needle situated in said needle bed between said first and second discs, said at least one needle moveable in one direction;

a thread-carrier for taking in the yarn on said needle which is moveable across said moving direction of said needle;

a gun connected to said needle;

a yarn guide;

a yarn feeder connected to said yarn guide for pushing out yarn; and a yarn retriever affixed in front of said needle, said yarn retriever having an edge having a jagged geometry that takes part in loop-formation.

5. The cross-knitting device of claim 4, wherein said gun comprises three bobbins situated around a common sleeve having a core located therein.

6. The cross-knitting device of claim 4, wherein said gun comprises two rotatable shafts, said at least one needle pressed upon one of said shafts.

7. The cross-knitting device of claim 4, wherein said gun comprises a double-sided air cylinder having a double-sided air piston inserted therein, said double-side air piston comprising two oppositely directed brushes.

8. The cross-knitting device of claim 4, wherein said yarn retriever comprises a shaft on which disks are connected, said disks having a soft external edge having changeable geometry that facilitates loop formation.

9. The cross-knitting device of claim 8, wherein said discs are connected to said shaft by a skidding clutch.

10. The cross-knitting device of claim 8, wherein said discs and said shaft are united.

11. The cross-knitting device of claim 8, wherein said soft external edge comprises a brush soft edge.

12. The cross-knitting device of claim 8, wherein said soft external edge comprises yarn-holding beds.

13. The cross-knitting device of claim 4, wherein said yarn feeder comprises two shafts specifically profiled to position of the yarn by pushing-out said yarn.

* * * * *